United States Patent [19]

Eckart

[11] Patent Number: 4,708,663

[45] Date of Patent: Nov. 24, 1987

[54] ROTATABLE ELECTRICAL ELBOW FITTING

[75] Inventor: George R. Eckart, Evanston, Ill.

[73] Assignee: Woodhead Industries, Inc., Northbrook, Ill.

[21] Appl. No.: 854,036

[22] Filed: Apr. 21, 1986

[51] Int. Cl.[4] ..... H01R 13/58

[52] U.S. Cl. ..... 439/469; 439/901; 439/502

[58] Field of Search ..... 339/89, 90, 136–140, 339/103 R, 103 M, 75 R, 75 M, 154 A, 1, 2, 8 R , 28, 29; 285/404, 280

[56] References Cited

U.S. PATENT DOCUMENTS

| | | | |
|---|---|---|---|
| 1,372,297 | 3/1921 | Kennedy | 285/280 |
| 2,374,971 | 5/1945 | Benander | 339/89 M |
| 3,150,231 | 9/1964 | Clark | 339/89 M |
| 4,136,921 | 1/1979 | Hardy et al. | 339/154 A |
| 4,390,226 | 6/1983 | Hohn | 339/75 M |
| 4,519,638 | 5/1985 | Yodoshi et al. | 285/404 |

FOREIGN PATENT DOCUMENTS

| | | | |
|---|---|---|---|
| 707605 | 6/1941 | Fed. Rep. of Germany | 285/404 |

*Primary Examiner*—Joseph H. McGlynn
*Assistant Examiner*—David Pirlot
*Attorney, Agent, or Firm*—Emrich & Dithmar

[57] ABSTRACT

An electrical fitting has a rigid tubular body in the form of an elbow with one connector insert rotatably received at one end of the body and a second connector insert fixed within the body in the other end. Insulated flexible wires within the body connect corresponding elements of the connector inserts. The fitting is particularly useful in establishing a quick disconnect for machines or instruments from a flexible feed cord while avoiding a "gooseneck" in the feed cord.

6 Claims, 6 Drawing Figures

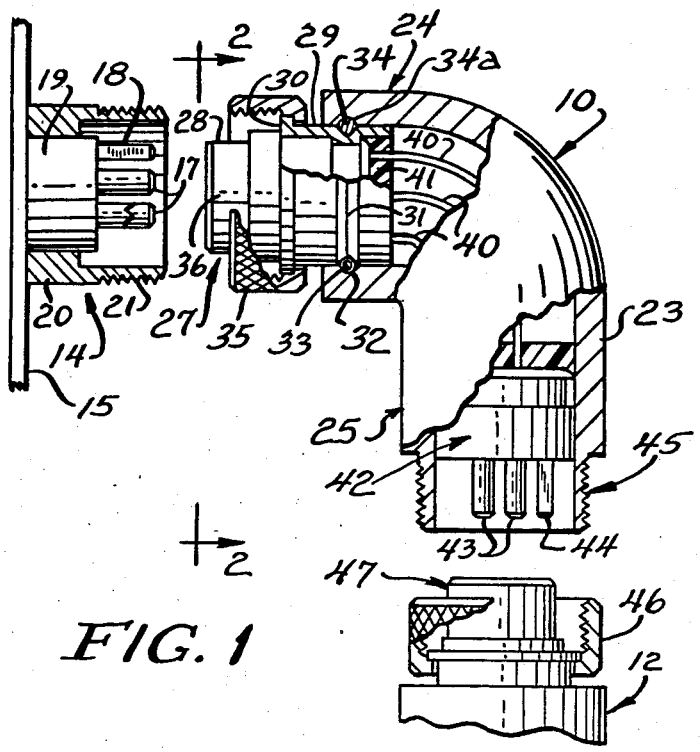
FIG. 1
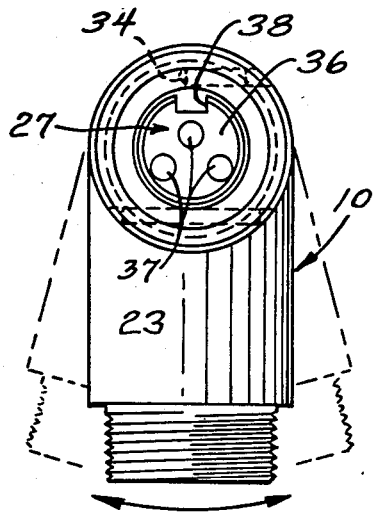
FIG. 2
FIG. 3
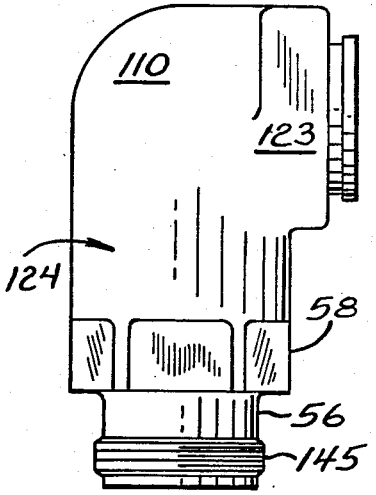
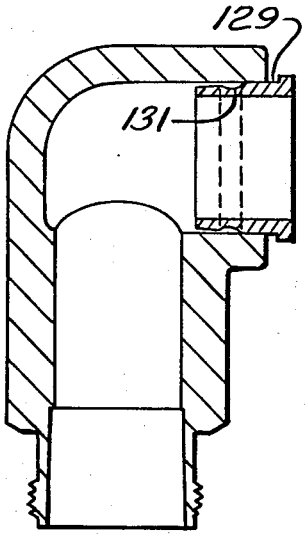
FIG. 5
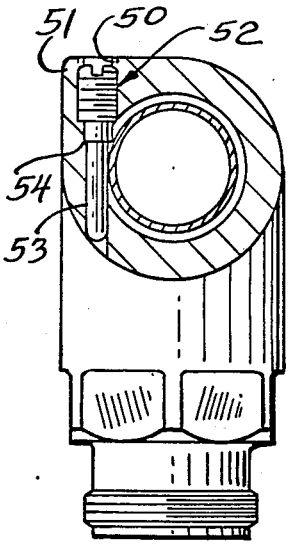
FIG. 6
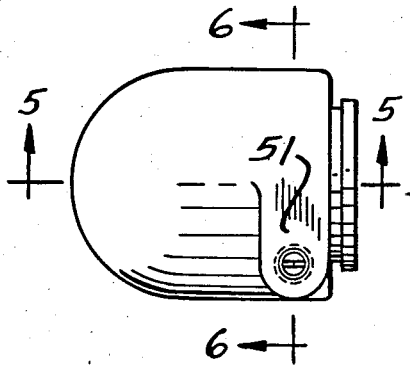
FIG. 4

ROTATABLE ELECTRICAL ELBOW FITTING

FIELD OF THE INVENTION

The present invention relates to electical fittings; and more particularly, it relates to a fitting for establishing electrical continuity between a multi-element connector on a feed cord and a corresponding mating connector which is fixed—for example, mounted to a machine or control panel. The fitting is an elbow or offset type connector which permits the feed cord to be dressed correctly and to avoid goosenecks or twists in the cord since they create undesirable stress on the connections between the wires and the insert connector elements.

BACKGROUND OF THE INVENTION

There are many applications in which electrical power lines as well as auxiliary electrical lines are established by means of multi-connector cord from one fixed location to another. In many applications it is undesirable to establish a semi-permanent connection as by soldering or using screws and terminal blocks. This is particularly true, for example, in the case of machines or instruments used in a production line. If a production line machine malfunctions or requires periodic maintenance, it is more desirable to use a plug and receptacle capable of being disconnected quickly to remove the defective machine and to replace it with an operative one by quickly coupling the plug and connector together again.

In many assembly line applications, the machine has a prong or blade-type male connector mounted to a vertical surface so that the connecting elements extend along a horizontal line. It is also commonplace to have such installations requiring connectors having two, three, four or even more poles. For example, in the case of a machine being connected by means of a cord to a controller, two wires may be used to connect a source of electrical power to the machine; one or more additional wires may be used to establish a control function from the controller to the machine; and one or more additional may be used to establish a sensing function at the machine. In such cases, it is necessary that provision be made so that the proper connecting elements are coupled to their corresponding connecting elements. Thus, an interfitting mechanical structure such as a key and key way may provide proper alignment, or alignment may be accomplished through an unique or asymmetrical configuration of the male/female connecting elements of the connector.

It is thus common that an electrical cord being connected to a fixed connector at a machine may have to be twisted on its own axis so that the connecting elements are properly aligned before the cord is assembled to the connector on the machine. Usually, a threaded nut will provide mechanical coupling to maintain the connection; however, the twisted cord may extend laterally outwardly from the machine in the form a gooseneqk and form an obstruction or unsightly, if not unsafe, arrangement. Any bumping of the cord will increase the stress on internal connection, already present due to the twisting of the cord. Thus, in some cases it may be difficult to locate properly or "dress" the cord relative to the machine plug so that the cord is out of the way and not likely to interfere with nearby work going on or to be inadvertently pulled or dislodged by a passing worker or other machine being moved.

As mentioned, a twisted cord hanging from a machine at a 90° angle, for example, may induce an undesirable bending moment between the wire and the connecting elements in the cord, thereby stressing that connection. In other words, if the connector at the end of a cord is requried to make a connection along a horizontal axis, as distinguished from a vertical axis along which the cord simply hangs, there is obviously an undesirable stress on the connector at the end of the cord and on the coupling itself, leaving the connector vulnerable to damage by passing machines or people or to fatigue through bending of the connector elements.

SUMMARY OF THE INVENTION

A primary advantage of the present invention is that it provides an electrical elbow fitting for a multiconnector cord which may be coupled to a fixed connector on a machine or the like and has an offset (45° or 90°, for example) while permitting the cord to be extended from any radial direction so that it remains properly dressed when the connection is established.

The fitting includes a rigid tubular body or housing in the form of an elbow having first and second cylindrical sections which are offset or angled relative to each other. The amount of offset may be whatever is desired up to 90°, or even more. One connector, namely, the one that attaches to the machine, not the feed cord (preferably, a female connector or receptacle) is provided with a cylindrical sleeve which is rotatably received in one cylindrical section of the rigid body; and a male connector or plug is fixed in the other cylindrical section of the body. Insulated flexible wires within the body connect the corresponding electrical connector elements of the two connectors.

The sleeve has some means, such as a coupling pin in a groove so that it cannot be removed from the body, although it may be freely rotated in the body when a connection is being made. Futher, the outer end of the sleeve may be flanged to receive a threaded nut adapted to couple to the fixed connector on the machine; and the fitting body may be provided with external threads about the fixed connector end for receiving the receptacle end of the cord in threaded engagement.

In assembling the elbow fitting to a machine, for example, first the rotatable receptacle of the fitting is aligned with the fixed connector on the machine and the two are assembled. The nut on the fitting is then secured to the fixed machine connector to establish mechanical stability. The body of the connector is then rotated on the sleeve of the receptacle so that the fixed plug of the body extends in the desired direction; and a set screw is then tightened to secure the body in the desired orientation relative to the sleeve of the receptacle. Finally, the cord is assembled electrically and mechanically to the fixed connector of the elbow fitting to complete the connection.

Thus, there is provided an electrical elbow fitting which may electrically connect a cord to a fixed connector while permitting the cord to be dressed at 90° relative to the axis of the fixed connector and to extend in any radial direction from the fixed connector and which permits a connection of the cord without having to twist or bend the cord in establishing the connection. The invention thereby avoids unsightly, inconvenient, and perhaps unsafe goosenecks in the cord.

Other features and advantages of the present invention will be apparent to persons skilled in the art from the following detailed description of two embodiments wherein identical reference numerals will refer to like parts in the various views.

THE DRAWING

FIG. 1 is a side view, partly in fragmentary form, showing an connecting device fitting incorporating the present invention and illustrating a typical use; and FIG. 2 is an end view of the device of FIG. 1 illustrating various orientations of the body relative to the axis of the rotatable insert.

FIG. 3 is a side view of an alternate embodiment of an electrical connecting device incorporating the present invention;

FIG. 4 is a top view of the device of FIG. 3;

FIG. 5 is a vertical cross-sectional view of the device of FIG. 3 taken through the sight line 5—5 of FIG. 4; and FIG. 6 is a vertical view, partly in cross-section, taken along the sight line 6—6 of FIG. 4.

DETAILED DESCRIPTION OF A PREFERRED EMBODIMENT

Referring then to the drawing, reference numeral 10 generally designates an electrical elbow fitting adapted to couple or establish electrical continuity between a flexible cord generally designated 12 and a fixed connector 14 which may be mounted to a side panel 15 of a machine or instrument.

As used herein, the terms "connector" or "insert" may refer either to a plug (having male connecting elements in the form of blades or prongs) or a receptacle (having corresponding apertures and configuration and internal connecting elements). Further, the term "elbow" refers to an angular fitting in the broad sense that the offset between the two sections of the fitting may be at 90° or they may be at, for example, 45° or any other desired offset.

In the illustrated embodiment, the fixed connector 14 is in the form of a plug having male connecting elements 17 and a non-conducting key of rectangular cross-section designated 18 extending from a insulating body 19 which serves to hold the connecting elements 17. Surrounding the body 19 is a sheath 20 of metal or plastic which is externally threaded as at 21.

In the preferred embodiment illustrated in FIGS. 1–2, there are three connecting elements, corresponding to three separate insulated wires within the cord 12; and, for illustrative purposes, the configuration of connecting elements may be triangular as seen in FIG. 2. To insure proper connection of corresponding elements, a mechanical key and key way are used, but persons skilled in the art will appreciate that the configuration or shape of connecting elements may equally well be used to insure connection of corresponding elements.

Referring now to the elbow fitting 10, it includes a generally hollow housing or shell 23 which includes first and second generally cylindrical sections 24, 25 which have their axes offset relative to one another at 90°.

A rotatable connector or "insert" is generally designated 27 and received in the cylindrical portion 24 of the fitting 10, and it includes a connector insulating body 28 fitted into a sleeve 29 which, in turn, is received in the cylindrical portion 24 of the fitting 23. The outer end of the sleeve 29 is flanged at 30 and the inner section is provided with circumferential groove 31 which registers with a corresponding bore 32 in the section 24 when the sleeve 29 is assembled to the connector body. A first pin 33 is received in the bore 32 in the section 24 and loosely received in the lower portion of groove 31 of sleeve 29 so that the housing 23 of connector 10 and sleeve 29 may rotate relative to each other, but the sleeve may not be removed from the body. An internally threaded nut 35 is received on the sleeve 29 and flange 30 prevents its complete removal. A set screw 34 received in threaded bore **34*a* is also received in the groove 31 so that when the screw 34 is inserted, it secured the sleeve 29 and insert 27 in place after the housing 23** has been dressed in the desired direction.

The connector body 28 has a reduced body portion 36 in which are provided apertures 37 (FIG. 2) for receiving the prongs 17 of plug 19. A key way 38 is also formed in the reduced body portion 36 of the receptacle 27 for receiving key 18. The insert 27 may be of conventional design having connecting elements embedded in it and adapted to engage and establish electrical continuity with the prongs 17 when they are inserted in the apertures 37. Individual insulated flexible wires 40 are connected to the internal connecting elements of insert 27 and extend out the back of the receptacle body 28 through potting compound and lie within the hollow interior of the housing 23 of the fitting 10.

The wires 40 extend to and are coupled with corresponding connecting elements in a fixed insert generally designated 42 which, in this case, is a plug mounted in the section 25 of the fitting 10. The insert 42 includes prongs 43 and a key 44 having shape and configuration, in the illustrated embodiment, corresponding with the prongs 17 and key 18 of the fixed plug 14, as previously described. However, the plug 42 may be an adaptor having a different configuration.

The exterior of the tubular section 25 of the fitting 10 may be threaded at 45 for receiving a correspondingly threaded nut 46 of a molded receptacle 47 formed in the feed cord 12.

In operation, the fitting 10 is placed adjacent the fixed plug 14 such that the aperture configuration of the rotatable receptacle 27 is aligned with the corresponding prongs 17; and the receptacle 27 and plug 14 are connected together. The nut 34 is then screwed onto the threads 21 of the fixed plug 14. This, of course, fixes the axial disposition of the rotatable connector 27, but the tubular body 23 of the fitting 10 may still be rotated about that axis until the axis of the insert 42 is properly aligned with the direction from which the cord 12 is being fed.

Because of the flexibility of the wires 40 and the fact that there is an excess length of those wires within the hollow confines of the body 23, they may be twisted a number of times without in any way effecting the operation of the fitting. Preferrably, the length of the wires 40 is such that the tubular body 23 of the fitting 10 may be rotated about the sleeve 29 a number of times without effecting the operation of the device or in creating an excess strain on the wires or their associated connectors. It is estimated that during normal usage, no more than three revolutions in any given direction on the body 23 relative to the sleeve 29 would be encountered during the life of the fitting.

Referring to FIG. 2, it will be observed that the body 23 of the fitting 10, as illustrated in dashed line, may assume any radial disposition relative to the axis of the insert 27 (which axis is perpendicular to the plane of the page of FIG. 2), and when the desired orientation is achieved, the set screw 34 is tightened to fasten the sleeve 29 to the cylindrical section 24 of the body 23.

Referring now to the embodiment illustrated in FIGS. 3–6, which is the preferred embodiment, reference numerals corresponding to the same or similar elements in the previously described embodiment will bear the same numeral preceded by a "1". Thus, the elbow fitting 110 includes angularly offset sections 123 and 124. In further description of the embodiment of FIGS. 3–6, primary concern will be with the differences between the two illustrated embodiments. The inserts may be identical to those already described.

As best seen in FIG. 5, a rotatable sleeve 129 for receiving the upper connector insert is provided with an annular recess or groove 131 which is aligned with a vertical bore 50 formed in a quadrant extension 51 of the section 123 of the fitting. The upper portion of the bore is threaded to receive a set screw 52 which also includes a cylindrical unthreaded pin or finger 53 and an enlarged central portion defining a shoulder 54. When the set screw 52 is loosened slightly, the pin 53 remains in partia1 engagement with the groove 132 on the sleeve 129, permitting relative rotation between the sleeve 129 (and the connector insert which is holes) and the body of the elbow 110. When the set screw 52 is then tightened after the fitting is properly dressed to receive the feed cord, the shoulder 54 engages the groove 132 and secures the sleeve 129 to the body of the elbow so that there may be no relative rotation between the two.

The other insert is received in a lower neck or extension 56 which is externally threaded to provide the threads 145 for the nut of the feed cord which is not illustrated in this embodiment.

The lower portion of the cylindrical section 124 of the elbow 110 may be formed into a nut as at 58 so that the elbow may be held with a wrench or other gripping tool in securing the power feed cord. The two embodiments illustrated are otherwise similar in function.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. An electrical connector device adapted to couple a connector of a flexible cord to a fixed connector comprising: a rigid, one-piece tubular body forming first and second cylindrical portions having their respective axes angularly inclined relative to each other; a first connector insert including a sleeve rotatably received in said first cylindrical portion whereby said insert may be rotated within said first cylindrical portion for adjustment over a continuous angular range relative to the axis of said second cylindrical portion; a second connector insert received in said second cylindrical portion of said body; each connector insert having a corresponding plurality of electrical connecting elements; a plurality of wires, each wire interconnecting corresponding connecting elements of said first and second connector inserts together and extending loosely and freely within said tubular body, the length of said wires being such that said sleeve may be twisted within said first cylindrical portion without excessively straining any of said wires or their associated connections; and releasable locking means for selectively fixing said sleeve to said first cylindrical portion of said body.

2. The device of claim 1 further including retainer means for preventing withdrawal of said sleeve from said first cylindrical portion of said fitting while permitting said sleeve to rotate within said first portion.

3. The device of claim 2 further including an internally threaded nut rotatably received on the outer portion of said sleeve and coupled thereto for mechanically fastening said receptacle to said fixed connector.

4. The apparatus of claim 2 wherein said second connector insert is a plug and the outer surface of said second cylindrical portion of said fitting is threaded for mechanically fastening to a corresponding nut of the connector of said cord.

5. The device of claim 1 wherein said sleeve includes a groove extending about a substantial portion of the periphery thereof, and said locking means includes a threaded fastener threadedly received in said first cylindrical portion of said body in alignment with said groove of said sleeve, whereby when said fastener is tightened it engages said sleeve within said groove to secure said sleeve to said body in a desired adjusted position and to prevent rotation of said sleeve.

6. The device of claim 5 wherein said fastener inclues a pin normally received in said groove and a shoulder adjacent said pin wherein when said fastener is loosened, said pin remains in said groove and retains said sleeve in said body while permitting said sleeve to be rotated within said body.

* * * * *